US007222450B2

(12) United States Patent
Cuprin et al.

(10) Patent No.: US 7,222,450 B2
(45) Date of Patent: May 29, 2007

(54) FIREARM SECURITY BLOCK AND FIREARM FITTED THEREWITH

(75) Inventors: Eugene Cuprin, Ashkelon (IL); Igor Donskoy, Ashkelon (IL)

(73) Assignee: N-Trance Security Ltd., Ashkelon (IL)

( * ) Notice: Subject to any disclaimer, the term of this patent is extended or adjusted under 35 U.S.C. 154(b) by 170 days.

(21) Appl. No.: 10/965,957

(22) Filed: Oct. 18, 2004

(65) Prior Publication Data

US 2006/0080881 A1 Apr. 20, 2006

(51) Int. Cl.
*F41A 17/06* (2006.01)

(52) U.S. Cl. ..... 42/70.11

(58) Field of Classification Search ..... 42/70.01, 42/70.11

See application file for complete search history.

(56) References Cited

U.S. PATENT DOCUMENTS 6,357,156 B1 * 3/2002 Klebes et al. ..... 42/70.11
6,357,157 B1 * 3/2002 Constant et al. ..... 42/84
6,412,207 B1 * 7/2002 Crye et al. ..... 42/70.06

* cited by examiner

*Primary Examiner*—Stephen M. Johnson
(74) *Attorney, Agent, or Firm*—Pearl Cohen Zedek Latzer, LLP

(57) ABSTRACT

The invention relates to locking devices preventing the unauthorized use of firearms. The invention provides a block, shaped partly as a normal magazine or a magazine or other shaped member which can be inserted into a firearm to block the magazine housing thereof or the barrel and which can be removed therefrom only by transmitting relevant biometric data to said block, said data corresponding with biometric data digitally stored in the block memory.

7 Claims, 4 Drawing Sheets

FIREARM SECURITY BLOCK AND FIREARM FITTED THEREWITH

FILED AND BACKGROUND OF THE INVENTION

The present invention relates to locking devices preventing the unauthorized use of firearms. More particularly, the invention provides a block, shaped partly as a normal magazine or a magazine or other shaped member which can be inserted into a firearm to block the magazine housing thereof or the barrel and which can be removed therefrom only by transmitting relevant biometric data to said block, said data corresponding with biometric data digitally stored in the block memory.

Little need be said about the desirability of preventing the use of handguns and rifles by children and by persons unauthorized to use the weapon. Handguns and rifles are often stolen by criminals, while mentally-unstable persons, and children, also find weapons of interest. Many lives could be saved if only the user or other authorized person were able to load and fire such weapons.

In the prior art it is seen that this can be achieved by locking the firearm to a fixed rack, or by fitting a lock to the trigger (U.S. Pat. No. 5,603,179 and WO026848), or by locking the safety switch (U.S. Pat. Nos. 5,946,840 and 5,461,812), or by blocking the firing mechanism (U.S. Pat. No. 6,347,538 B1, US Patent 2002,0174585A1 and 2004/0035286A1), or by blocking the ejector and loading port (US Patent no. 2004/0035042) or by blocking the barrel of the firearm (Swedish patent no. SE505705, and UK patent applications GB2316473A and GB2375588A).

The present invention refers primarily to a class of device blocking the magazine housing to prevent loading of the weapon by unauthorized persons or similar devices. It will however be realized that all such systems also require means for preventing the loading of a single cartridge through an aperture provided for this purpose at the top or side of the firearm.

In U.S. Pat. No. 4,532,729 Von Muller discloses a key-operated safety magazine which is locked to the magazine housing. In some or all embodiments it is necessary to drill a hole in the pistol or rifle before inserting the safety magazine. Aside from the inconvenience of doing so by means of a special drilling jig seen in FIG. 6, the hole will cancel the manufacturers guarantee for the firearm.

OBJECTS OF THE INVENTION

It is therefore one of the objects of the present invention to obviate the disadvantages of prior art firearm locking devices and to provide a magazine block or barrel block which can be retrofitted to the weapon without requiring any modification of the weapon for this purpose.

It is a further object of the present invention to eliminate the key (which can be lost or stolen) used in prior art devices, and to use instead a lock responsive to a relevant biometric input.

It is a further aim of the present invention to provide a magazine block which also prevents the loading of a single cartridge.

SUMMARY OF THE INVENTION

The present invention achieves the above objects by providing a firearm magazine or barrel block to prevent unauthorized loading of a firearm having removable magazine feed, and which can be retrofitted to existing weapons without said weapons requiring any modification, the magazine block comprising

- a magazine or magazine-like body dimensioned to fit into the magazine housing or barrel of a firearm such as a hand gun or a rifle;
- an electrically-operated lock supported by said body and retaining said body in said magazine housing or barrel, said lock being operatively connected to at least one normally-extended sliding dead bolt projecting into a recess in said firearm when said lock is not powered, thereby preventing removal of said body from said firearm while allowing removal thereof when said lock is powered to retract said deadbolt; and
- an electric/electronic package housed inside said body including
  - a power supply;
  - means for inputting biometric data;
  - a memory for storing biometric data of the intended user(s);
  - means for comparing newly received data with data stored in said memory, and
  - means for operating said lock to retract said deadbolt; said body having an end projection entering a space preventing a cartridge from occupying a position required for loading or firing a single cartridge, said lock being opened by a signal from a biometric identity verifier to enable removal of said block if said new biometric data matches said stored data, and retaining said block in said firearm when no match is found.

In a preferred embodiment of the present invention there is provided a magazine block wherein said biometric data is a fingerprint, and said means for inputting biometric data is a fingerprint sensor.

In a most preferred embodiment of the present invention there is provided a firearm such as a pistol or rifle in combination with said block.

Yet further embodiments of the invention will be described hereinafter.

It will thus be realized that the novel device of the present invention will be marketed in various sizes and configurations to suit all or most firearms in use at the time. Although a number of different outer shaped housings will be required, the inner components of the magazine or magazine-like body block will remain the same so that costs are lowered and quantities to be manufactured are high.

It is important to know that the magazine block of the present invention can be fitted to a firearm without requiring any modification. This is significant because aside from the cost of executing a modification of the weapon any such action automatically invalidates the manufacturers' guarantee of the weapon.

SHORT DESCRIPTION OF THE DRAWINGS

The invention will now be described further with reference to the accompanying drawings, which represent by example preferred embodiments of the invention. Structural details are shown only as far as necessary for a fundamental understanding thereof. The described examples, together with the drawings, will make apparent to those skilled in the art how further forms of the invention may be realized.

In the drawings:

FIGS. 1*a* and 1*b* are diagrammatic views of a preferred embodiment of the block according to the invention;

FULL DESCRIPTION OF THE INVENTION

Figure 1A:
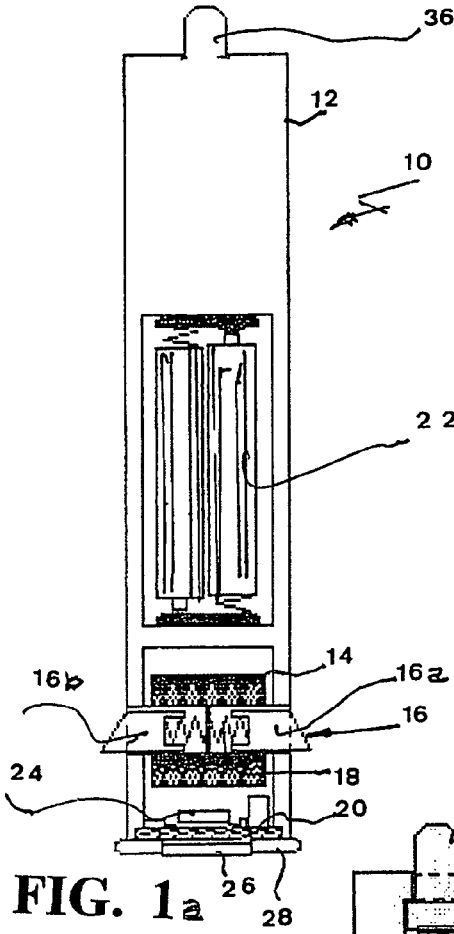
Figure 1B:
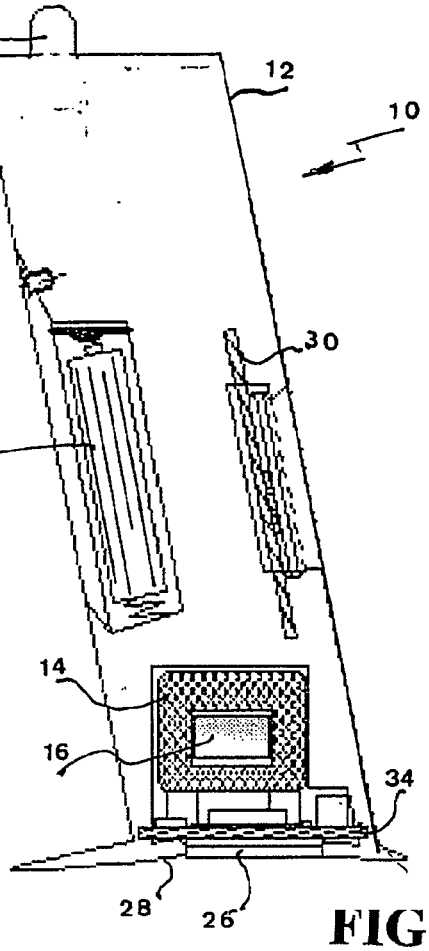
Figure 6:
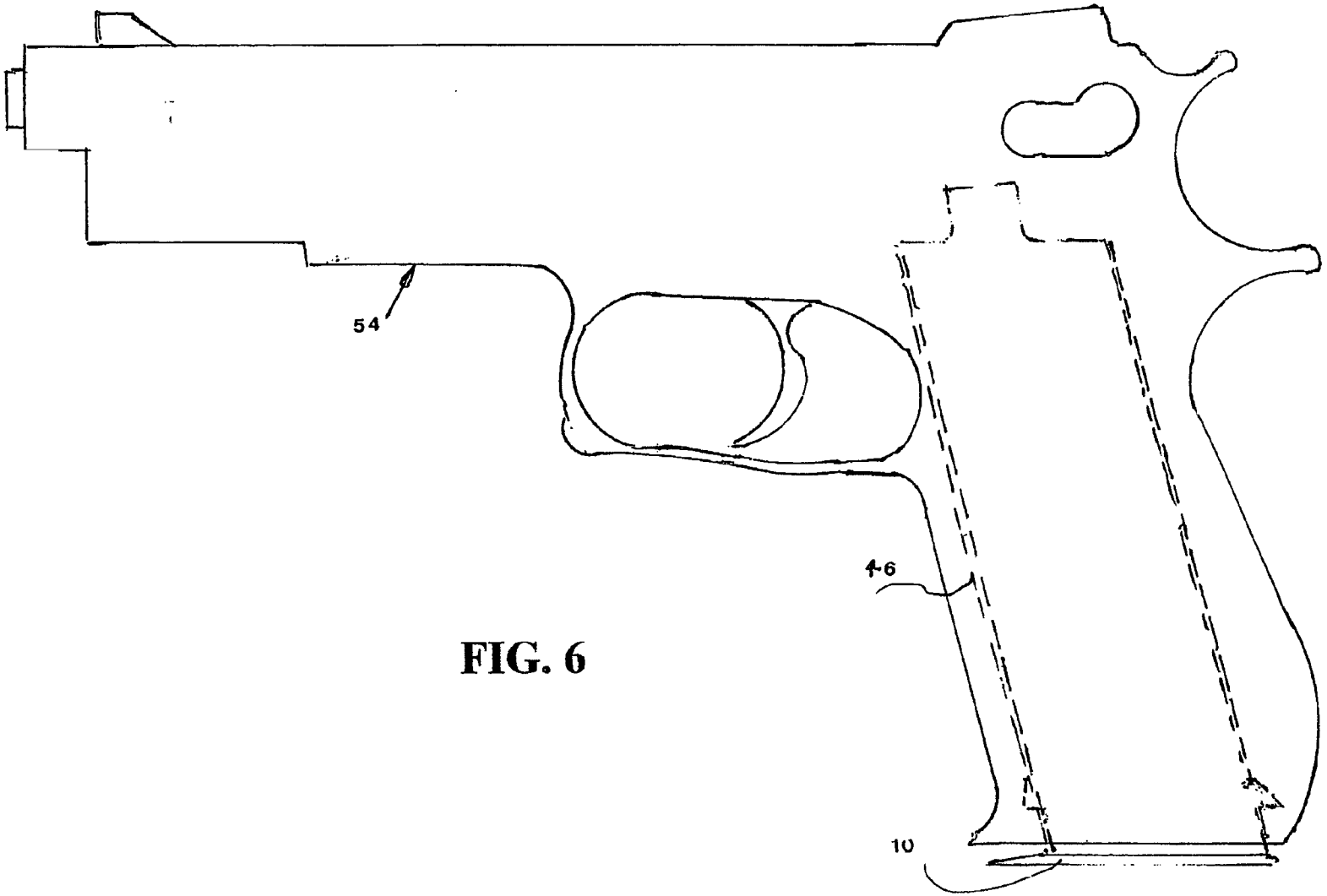
FIG. 6 is an outline view of a pistol fitted with the block.

There is seen in FIGS. 1*a* and 1*b* a firearm magazine block 10 to prevent unauthorized loading of a firearm, seen in FIG. 6, having a removable magazine feed. It is obvious that a normal magazine carrying cartridges cannot be inserted into the firearm before removal of the block 10, which however is locked in the magazine housing.

The magazine-like body 12 is dimensioned to fit into the magazine housing of a firearm such as a hand gun or a rifle, as seen in FIG. 6.

An electrically-operated lock 14 is supported by the block body 12 retaining the body 12 in the magazine housing. The lock 14 is operatively connected to a normally-extended sliding dead bolt 16 projecting into a recess in the firearm. When the lock 14 is not powered, the bolt 16*a*, 16*b*, shown in two opposing segments pushed apart by a spring 18, prevents removal of the block 10 from the firearm. In order to load the firearm the lock must be powered to retract the two segments 16*a*, 16*b* allowing removal of the block 10.

An electric/electronic package 20 is housed inside the block body 12. The package shown includes a power supply 22 comprising a pair of standard cells, and a microprocessor 24.

Means are provided for inputting biometric data of the authorized user; which comprise the fingerprint sensor 26 accessible at the free end 28 of the block body 12. In the shown embodiment the biometric data is a fingerprint. A digital image of the fingerprint of the authorized user is stored in a memory 30 such as a flash memory chip or SIM. The memory 30 could be integral to the microprocessor 24.

Means for receiving and inputting the biometric data, i.e. a fingerprint sensor 26 is operatively connected to a verifier 34 shown in the diagram as a separate item. The verifier 34 can also be a part of the microprocessor 24 compares the newly received fingerprint data with data stored in the memory 30. If a match is found the verifier 34 sends a signal to the lock 14 to withdraw the bolt sectors 16*a*, 16*b* allowing removal of the block. The lock 14 shown is in practice an electro magnet, which when powered, retracts the deadbolt 16. The block 10 remains locked in the firearm when no match is found.

The acceptance threshold should be determined specifically for each system and fingerprint sensor. 100% match demonstrates that the latent fingerprint is used. The system software will reject such match as suspicious. Usually systems rely on 50% to 90% similarity.

Figure 7:
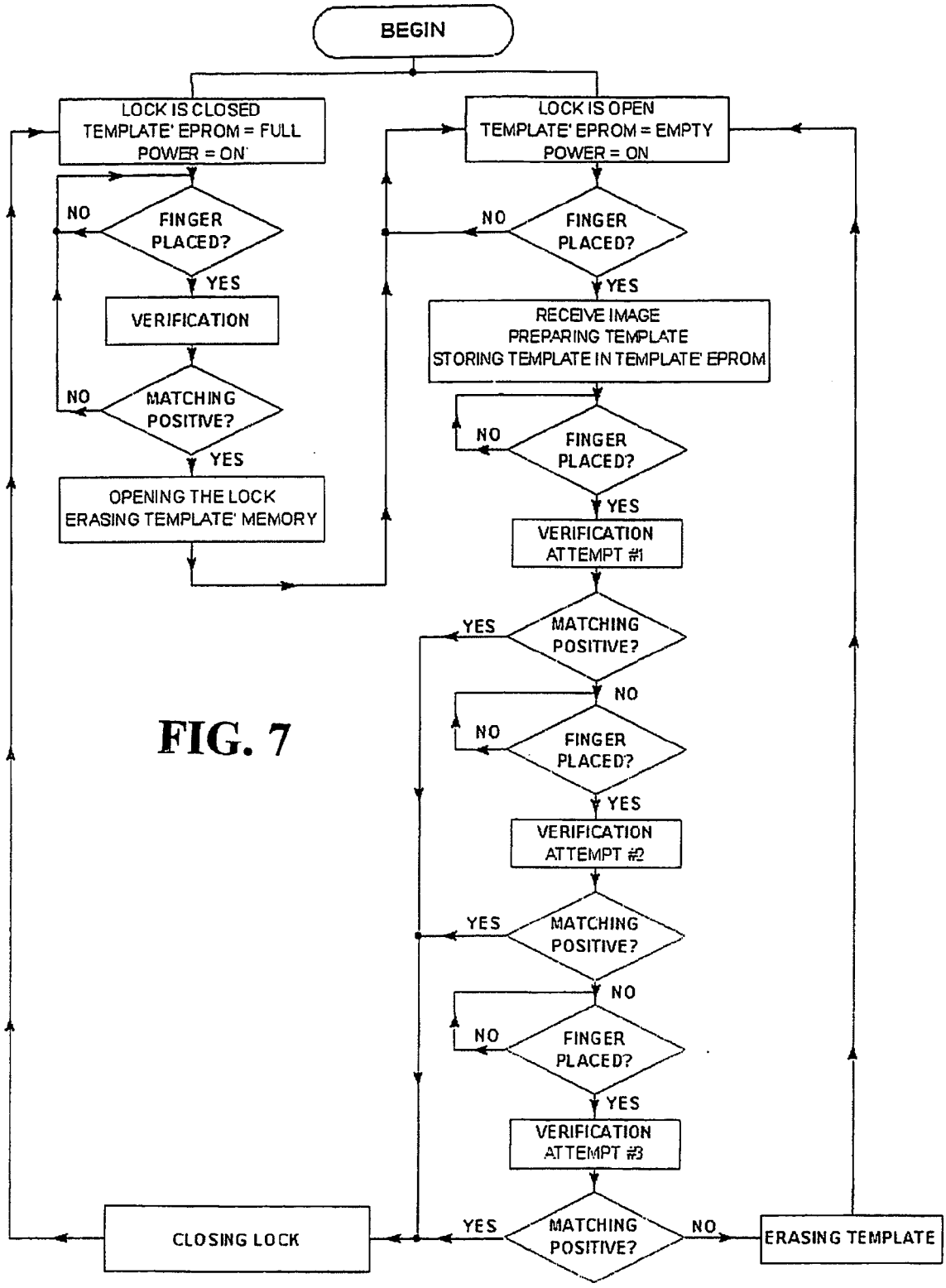
FIG. 7 is a diagram showing the logical steps programmed into a microprocessor for operation of the device.

A flowchart which will be seen in FIG. 7 shows that several attempts are made to match the fingerprint images before shut down. The fingerprint scanned while locking the device should be verified. This is done in order to ensure that the initial fingerprint input is good enough and will not cause problems when authorized user attempts to open it. If verification fails 3 times, which demonstrates poor initial input;—the fingerprint should be scanned again.

The block body 12 has an end projection 36 entering a space in the breech of the firearm preventing a cartridge from occupying a position required for loading or firing a single cartridge. The lock is operated by a signal from a biometric identity verifier. If the new biometric data matches or almost matches the stored data, the bolt is withdrawn allowing release and removal of the block.

The block 10 can be retrofitted to existing weapons without the weapons requiring any modification.

With reference to the rest of the figures, similar reference numerals have been used to identify similar parts.

Figure 2:
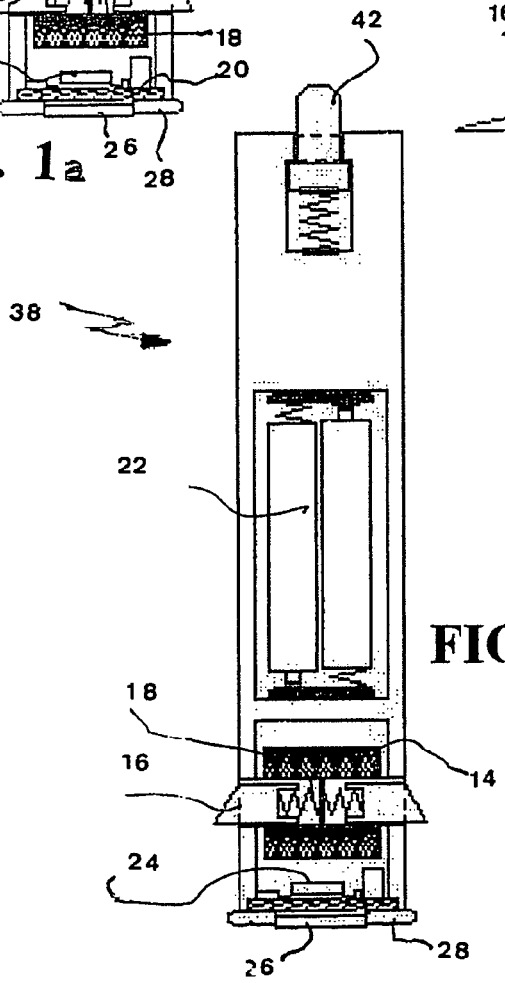
FIG. 2 is a diagrammatic view of an embodiment wherein the upper extension is spring loaded.

Referring now to FIG. 2, there is seen a detail of a magazine block 38 wherein the end projection, seen as 36 in FIG. 1, is a spring-loaded plunger 42. The spring loaded plunger 42 is appropriate for firearms where the firing mechanism prevents access to the plunger 42, so that the plunger cannot be pushed downwards by an unauthorized person wishing to load and fire the weapon.

Figure 3:
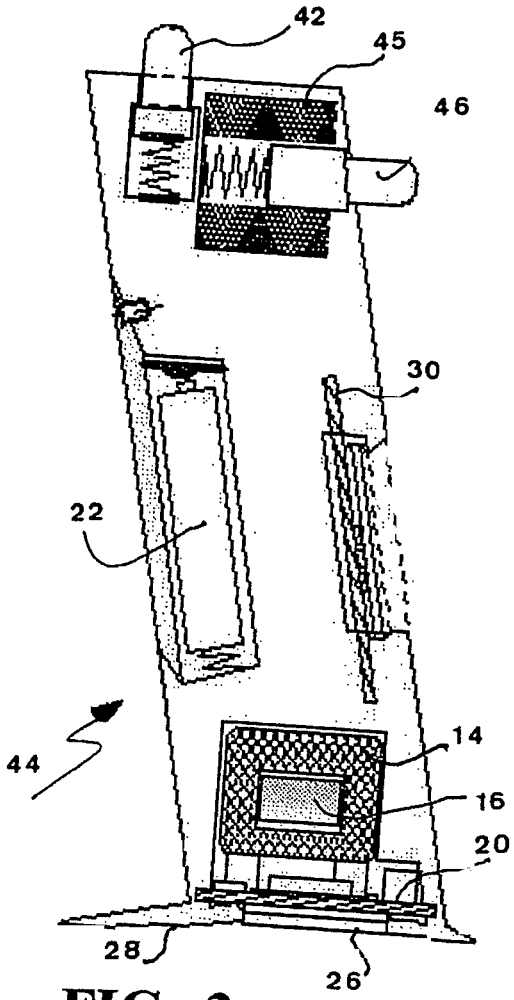
FIG. 3 is a diagrammatic view of an embodiment wherein a second plunger is operated in tandem with the first plunger.

FIG. 3 illustrates an embodiment wherein the magazine block 44 is further provided with a second deadbolt 46 supported by the body 45 and acting in tandem with the first deadbolt 16. This arrangement is advantageous for circumstances where the possibility exists that a determined effort might be made by an unauthorized person to remove the block 44 and to use the firearm. The bolt 46 can be withdrawn when the electro magnetic coil 45 is powered. As the block 44 is locked to the magazine housing of the firearm in three different locations, efforts to remove same by unauthorized persons will not succeed. 45—is a solenoid, pulling a deadbolt 46, according to a command from verifier.

Figure 4:
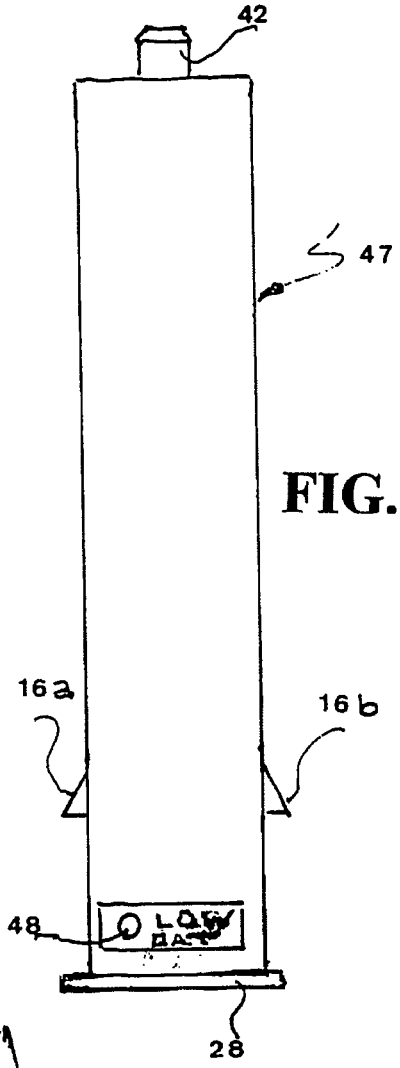
FIG. 4 is a side view of an embodiment including a low-battery warning.

Seen in FIG. 4 is a magazine block 47 further provided with a LED status display being a low-battery warning light 48. Replacing or recharging the cells 22 seen in FIG. 1*a* to provide the needed power is important as otherwise the firearm cannot be prepared for use.

Figure 5:
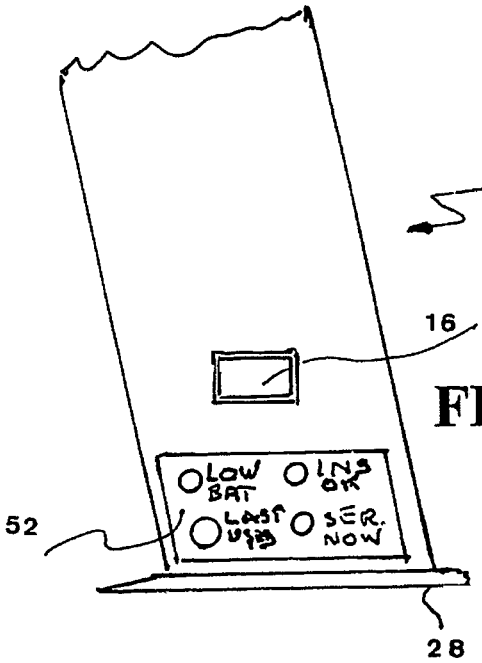
FIG. 5 is a fragmented elevational view of an embodiment provided with a LCD providing the user with additional useful information.

Referring now to FIG. 5, there is depicted a magazine block 50 further provided with a LCD display 52 providing data on gun status, state of the battery warning, when last used, time to service and similar useful data.

FIG. 6 shows a firearm 54 in combination with a magazine block 10. Although the block 10 can be distributed and sold as a retrofit item, there are advantages to marketing the firearm together with the block, as this allows factory testing of the combination and safe transportation and storage. Furthermore customer mistakes can be avoided, such as a purchaser buying a magazine block which is incompatible to the weapon for which it is intended.

FIG. 7 is a flow chart showing the conditions under which the lock releases the magazine block. The chart is self explanatory.

The program is held in a ROM memory of the microprocessor referred to in FIG. 1.

The described invention primarily refers to a magazine-like body however a normal magazine could also be used fitted with all components. Likewise a barrel block member could be used to block the barrel.

The scope of the described invention is intended to include all embodiments coming within the meaning of the following claims. The foregoing examples illustrate useful forms of the invention, but are not to be considered as limiting its scope, as those skilled in the art will be aware that additional variants and modifications of the invention can readily be formulated without departing from the meaning of the following claims.

We claim:

1. A firearm magazine block to prevent unauthorized loading of a firearm having removable magazine feed, and which can be retrofitted to existing weapons without said weapons requiring any modification, the magazine block comprising:

a magazine or a substantially magazine shaped body dimensioned to fit into a magazine housing of a firearm;

an electrically-operated lock supported by said body and retaining said body in said magazine housing, said lock being operatively connected to at least one normally-extended sliding dead bolt projecting into a recess in said firearm when said lock is not powered, thereby preventing removal of said body from said firearm while allowing removal thereof when said lock is powered to retract said deadbolt;

a power supply;

means for inputting biometric data;

a memory for storing biometric data of at least one authorized user;

means for comparing newly received data with data stored in said memory; and means for operating said lock to retract said deadbolt, said body having an end projection entering a space preventing a cartridge from occupying a position required for loading or firing a single cartridge, said lock being operated by a signal from a biometric identity verifier if said new biometric data matches said stored data, and retaining said block in said firearm when no match is found.

2. The block as claimed in claim 1, wherein said biometric data is a fingerprint, and said means for inputting biometric data is a fingerprint sensor.

3. The block as claimed in claim 1, wherein said end projection is a spring-loaded plunger.

4. The block as claimed in claim 1, further provided with a second deadbolt supported by said body and acting in tandem with said first deadbolt.

5. The block as claimed in claim 1, further provided with a LED status display and low battery warning display.

6. The block as claimed in claim 1, further provided with a LCD display providing data on at least one of a list comprising gun status, state of the battery warning, when last used and time to service.

7. A firearm in combination with a magazine block as claimed in claim 1.

* * * * *